US007268091B2

(12) United States Patent
Xing et al.

(10) Patent No.: US 7,268,091 B2
(45) Date of Patent: Sep. 11, 2007

(54) FIBER MAT AND PROCESS FOR MAKING SAME

(75) Inventors: Linlin Xing, Wayne, NJ (US); William Bittle, York, SC (US)

(73) Assignee: Building Material Investment Corporation, Wilmington, DE (US)

( * ) Notice: Subject to any disclaimer, the term of this patent is extended or adjusted under 35 U.S.C. 154(b) by 26 days.

(21) Appl. No.: 11/207,290

(22) Filed: Aug. 19, 2005

(65) Prior Publication Data

US 2007/0042659 A1 Feb. 22, 2007

(51) Int. Cl.

| | |
|---|---|
| ***B32B 17/02*** | (2006.01) |
| ***B32B 17/12*** | (2006.01) |
| ***B32B 5/02*** | (2006.01) |
| ***B32B 9/04*** | (2006.01) |

(52) U.S. Cl. ..... 442/180; 428/299.4; 428/355 AK; 442/154; 442/155

(58) Field of Classification Search ..... 428/299.4, 428/325; 442/155, 180, 154
See application file for complete search history.

(56) References Cited

U.S. PATENT DOCUMENTS

| | | | | |
|---|---|---|---|---|
| 4,135,027 | A * | 1/1979 | Anthony et al. | 428/195.1 |
| 5,258,098 | A * | 11/1993 | Wagner et al. | 216/52 |
| 5,914,365 | A * | 6/1999 | Chang et al. | 524/512 |
| 6,207,778 | B1 * | 3/2001 | Jachowicz et al. | 526/258 |
| 6,642,299 | B2 * | 11/2003 | Wertz et al. | 524/512 |

* cited by examiner

*Primary Examiner*—Lynda Salvatore
(74) *Attorney, Agent, or Firm*—William J. Davis; Walter J. Katz

(57) ABSTRACT

A fiber mat of improved wet web strength and a process of making same is disclosed. The fiber mat comprises fibers; a resinous fiber binder; and a vinylpyrrolidone/acrylic acid/lauryl methacrylate terpolymer.

6 Claims, No Drawings

FIBER MAT AND PROCESS FOR MAKING SAME

BACKGROUND OF THE INVENTION

1. Field of the Invention

The present invention relates generally to a fiber mat and a process of making the same. In particular, the present invention relates to a glass fiber mat comprising fibers, a binder and a binder modifier. Embodiments of the present invention can have desired characteristics, such as, for example, improved wet web strength and dry mat tensile strengths as compared with a conventional mat where no modifier is employed, and can be suitable for use in building materials.

2. Description of the Prior Art

High strength fiber mats have become increasingly popular in the building materials industry. Most commonly used in roofing shingles, fiber mats have numerous other material applications, including use in roofing, siding and floor underlayment; insulation facers; floor and ceiling tile; and vehicle parts.

Various fiber mats and methods of making the same have been previously described. For example, U.S. Pat. Nos. 4,135,029; 4,258,098; 5,914,365; and 6,642,299 describe glass fiber mats made by a wet-laid process. Glass fiber mats made by the wet-laid process are formed from glass fibers held together by a binder material. The last two patents relate to improved wet web strength with styrene-maleic anhydride copolymer (SMA), styrene-acrylate copolymers, and mixtures thereof.

Typically, in wet processed glass fiber mats, the binder is applied in a liquid form and dispersed onto the glass fibers by a curtain type applicator. Conventional wet processes strive to produce a uniform coating of binder on the glass fibers. After the binder and glass fibers have been dried and cured, the glass fiber mat is cut as desired.

A major problem in the manufacturing process and use of some known fiber mats is inadequate wet web strength. The wet web strength of wet glass mat has significant impact on runnability of glass mat production and mat properties. In order to prevent mat web from breaking during production, the production line speed has to be reduced due to a lower wet web strength of wet glass mat before curing. Also, a lower wet web strength requires a higher vacuum drawing to support the wet web and minimize web breaking. But the higher vacuum drawing will lead to undesired mat property, such as a high mat tensile ratio.

Inadequate dry mat tensile strengths also can reduce the ability of the finished roofing product to resist stresses during service on the roof. Because building materials, generally, and roofing shingles, in particular, are often subjected to a variety of weather conditions, the fiber mats should also maintain their strength characteristics under a wide range of conventional conditions.

SUMMARY OF THE INVENTION

Responsive to the foregoing challenges, a fiber mat for use in a building materials component has been developed. In one embodiment, the fiber mat comprises: a plurality of fibers; a resinous fiber binder, the fibers fixedly distributed in the binder; and a binder modifier which is a vinylpyrrolidone/acrylic acid/lauryl methacrylate terpolymer (VP/AA/LM). By "fixedly distributed", it is meant chemically bonded with binder. The terpolymer comprises from about 0.1 wt. % to about 50 wt. %, based on the weight of the binder.

The present invention also relates to a binder composition. The inventive binder composition includes a blend of a resinous fiber binder and a binder modifier which is a vinylpyrrolidone/acrylic acid/lauryl methacrylate terpolymer.

In addition to the above, the present invention also provides a process for making a fiber mat. In one embodiment, the process comprises the steps of: forming an aqueous fiber slurry; removing water from the fiber slurry to form a wet fiber mat; saturating the wet fiber mat with an aqueous solution of a fiber binder and a VP/AA/LM terpolymer modified polymer; and forming, via drying and curing, a fiber mat product from said wet fiber mat.

The fiber mats in accordance with some embodiments of the present invention can be particularly suitable for use as a component of building materials. In addition, the process of making fiber mats in accordance with some embodiments of the present invention can provide an improved wet web strength to an uncured mat as well as improved dry mat tensile strengths.

In this invention, the glass mats made from UF resin modified with the VP/AA/LM terpolymer exhibit improved wet web strength, and dry mat tensile strengths.

Additional advantages of embodiments of the present invention are set forth, in part, in the description which follows and, in part, will be apparent to one of ordinary skill in the art from the description and/or from the practice of the invention.

DETAILED DESCRIPTION OF THE INVENTION

As stated above, the fiber mat of the present invention comprises a plurality of fibers fixedly distributed in a fixative composition. The fixative composition comprises between about 0.05 wt. % and about 45 wt. % fiber binder, based on the fiber mat product weight, and between about 0.1 wt. % and about 50 wt. % of a VP/AA/LM terpolymer based on the binder weight.

As will be apparent to one of ordinary skill in the art, the VP/AA/LM terpolymer is commercially available, e.g. Styleze® 2000 (International Specialty Products), U.S. Pat. No. 6,207,778, the disclosure of which is hereby incorporated by reference in its entirety.

In one embodiment of the present invention, the fiber binder comprises a formaldehyde type resin. The fiber binder can include, but is not limited to, a urea/formaldehyde resin, a phenol/formaldehyde resin, a melamine/formaldehyde resin, and/or a mixture thereof. It is contemplated, however, that other binders, such as, for example, ethylene vinyl acetate, and other known resins adapted for binding mat fibers can be used without departing from the scope and spirit of the present invention.

In one embodiment of the present invention, the urea-formaldehyde resin is a commercially available material, such as, for example, GP2997 supplied by Georgia Pacific Resins, Inc.; Dynea® 246 from Dynea Co.; and Borden FG® 486D from Borden Chemical Inc. Other commercial formaldehyde resins, such as, for example, S-3701-C supplied by Pacific Resins and Chemicals, Inc.; and PR-913-23, supplied by Borden Chemical, Inc. As will be apparent to those of ordinary skill in the art, other commercially or non-commercially available binders can be used without departing from the scope and spirit of the present invention.

In one embodiment of the present invention, the resinous fiber binder can contain methylol groups which, upon curing, form methylene or ether linkages. These methylols can include, for example, N,N'-dimethylol; dihydroxymethylolethylene; N,N'-bis(methoxymethyl), N,N'-dimethylol-propylene; 5,5-dimethyl-N,N'-dimethylolpropylene; N,N'-dimethylolethylene; N,N'-dimethylolethylene and the like.

In one embodiment, the weight ratio of resinous fiber binder to terpolymer modifier is in the range from about 200:1 to about 4:1. In one embodiment of the present invention, the weight ratio is more particularly from about 99:1 to about 9:1.

The fiber binder and the terpolymer binder modifier are adapted to be compatible. The components can be intimately admixed in an aqueous medium to form a stable emulsion which does not become overly gummy, or gel, potentially even after prolonged storage, e.g., for periods of a year or longer. This can be advantageous in practical commercial use of the inventive composition.

In one embodiment of the present invention, the fibers comprise glass fibers. The glass fibers can comprise individual fiber filaments having an average length in the range of, but not limited to: from about ¼ inch to about 3 inches, and an average diameter in the range of, but not limited to: from about 1 to about 50 microns (μ). It is contemplated, however, that the glass fibers can be in another form, such as, for example, a continuous strand or strands. In an alternative embodiment of the present invention, the fibers can comprise other fibers, including, but not limited to: wood, polyethylene, polyester, nylon, polyacrylonitrile, and/or a mixture of glass and one or more of the other fibers. In one embodiment, the fiber mat can further comprise a small amount of filler, e.g., less than about 0.5%, based on the fiber weight. A fiber mixture can be optional for construction material applications, such as, for example, roofing and siding, because excessive amounts of filler can reduce porosity and vapor ventability of the fiber mat.

In the finished cured mat product, the fiber content can be in the range from about 55 wt. % to about 98 wt. %. In one embodiment of the present invention, the fiber content is more particularly in the range from about 70 wt. % and about 85 wt. %.

The fiber mat in accordance with one embodiment of the present invention can further comprise a fiber dispersing agent for dispersing the plurality of fibers in the fixative composition. The fiber dispersing agent can comprise, for example, tertiary amine oxides (e.g., N-hexadecyl-N,N-dimethyl amine oxide, bis(2-hydroxyethyl) tallow amine oxide, dimethyl hydrogenated tallow amine oxide, dimethylstearyl amine oxide and the like, and/or mixtures thereof). As will be apparent to those of ordinary skill in the art, other known dispersing agents can be used without departing from the scope and spirit of the present invention. The dispersing agent can comprise a concentration in the range from about 10 ppm to about 8,000 ppm, based on the amount of fiber. The dispersing agent can comprise a concentration in the range from about 200 ppm to about 1,000 ppm, based on the amount of fiber.

In one embodiment, the fiber mat can further comprise one or more viscosity modifiers. The viscosity modifier can be adapted to increase the viscosity of the binder and/or the fixative composition such that the settling time of the fibers is reduced and the fibers can be adequately dispersed. The viscosity modifier can include, but is not limited to, hydroxyl ethyl cellulose (HEC), polyacrylamide (PAA), and the like. As will be apparent to those of ordinary skill in the art, other viscosity modifiers can be used without departing from the scope and spirit of the present invention.

The fiber fixative composition employed herein can be prepared by blending the selected binder and the VP/AA/LM terpolymer in water, under agitation until a uniform mixture is obtained. The resulting aqueous mixture can then be used to saturate the wet mat of dispersed fibers, after which the excess mixture can be removed before drying and curing at an elevated temperature. Alternatively, an aqueous mixture of the binder alone can be prepared and applied to the wet mat of dispersed fibers, in which case the terpolymer can be separately and subsequently applied by spraying, dipping or other means. In still another alternative embodiment, all or a portion of the terpolymer can be applied over the mat after initiation of the drying and/or curing process.

The process of making a fiber mat in accordance with one embodiment of the present invention will now be described. The process will be described with particular reference to a wet-laid process. It is contemplated, however, that other processes known in the art, such as, for example, a dry-laid process, can be used without departing from the scope and spirit of the present invention. Furthermore, the process is described using chopped bundles of glass fibers. As discussed above, however, other types of fiber content are considered well within the scope of the present invention.

The process of forming glass fiber mats according to one embodiment of the present invention comprises adding chopped bundles of glass fibers of suitable length and diameter to a water/dispersant agent medium to form an aqueous fiber slurry. A viscosity modifier or other process aid can optionally be added to the water/dispersant agent medium. For example, about 0.05 to about 0.5 wt. % viscosity modifier in white water can be suitably added to the dispersant to form the slurry.

The glass fibers can be sized or unsized, and can be wet or dry, as long as they are capable of being suitably dispersed in the water/dispersant agent medium. The fiber slurry, containing from about 0.03 wt. % to about 8 wt. % solids, is then agitated to form a workable dispersion at a suitable and uniform consistency. The fiber slurry can be additionally diluted with water to a lower fiber concentration to between about 0.02 wt. % and about 0.08 wt. %. In one embodiment, the fiber concentration can be more particularly diluted to about 0.04 wt. % fiber. The fiber slurry is then passed to a mat-forming machine such as a wire screen or fabric for drainage of excess water. The excess water can be removed with the assistance of vacuum.

The fibers of the slurry are deposited on the wire screen and drained to form a wet fiber mat. The wet mat is then saturated by soaking in an aqueous solution of the binder or binder/modifier fixative composition. The aqueous solution can comprise, for example, from about 10 wt. % to about 40 wt. % solid. The wet mat can be soaked for a period of time sufficient to provide the desired fixative for the fibers. Excess aqueous binder or binder/modifier composition is then removed, preferably under vacuum.

After treatment with binder or binder/modifier composition, if desired, the mat is then dried and the fixative composition is cured in an oven at an elevated temperature (greater than about 150° C.). A temperature in the range of about 160° C. to about 350° C., for at least about 2 to 10 seconds, is typically used for curing. In one embodiment, a cure temperature in the range of about 225° C. to about 300° C. is used. It is contemplated that in an alternative embodiment of the present invention, catalytic curing can be provided with an acid catalyst, such as, for example, ammonium chloride, p-toluene sulfonic acid, or any other suitable catalyst. As discussed above, any amount of modifier not included with the binder solution can be applied to the drained fiber slurry, the drained mat containing binder, and/or the cured product. The binder modifier can be applied as a spray and/or as a bath as an aqueous solution of the VP/AA/LM terpolymer.

The combination of the terpolymer and binder used in various embodiments of the present invention provides several advantages over current binder compositions, particularly wet web strength, and dry mat tensile strengths.

Having generally described various embodiments of the present invention, reference is now made to the following examples which illustrate embodiments of the present invention and comparisons to a control sample. The following examples serve to illustrate, but are not to be construed as limiting to, the scope of the invention, as set forth in the appended claims.

EXAMPLES 1–3

Preparation of Glass Mat

Part A. In a 20 liter vessel at room temperature, under constant agitation, 5.16 g of chopped bundles of glass fibers, having an average 20–40 mm length and 12–20 micron diameter, were dispersed in 12 liters of water containing 800 ppm of N-hexadecyl-N,N-dimethylamine oxide to produce a uniform aqueous slurry of 0.04 wt. % fibers. The fiber slurry was then passed onto a wire mesh support with dewatering fabric, and a vacuum was applied to remove excess water and to obtain a wet mat containing about 60% fibers.

Part B. For Example 1, an aqueous solution of 24 wt. % solids containing urea/formaldehyde resin binder (UF) and Styleze® terpolymer, i.e., VP/AA/LM, as indicated in Table 1, were separately prepared and applied to individual samples of wet glass mats prepared by the procedure in Part A. The individual wet mats were soaked in the binder/terpolymer modifier solutions under ambient conditions after which excess solution was removed under vacuum to provide binder/terpolymer modifier wet mats containing 38 wt. % glass fibers, 12 wt. % binder/terpolymer modifier and 50 wt. % water.

Part C. For comparison purposes, Example 2 was prepared as described in Parts A and B except that the UF binder was used with OmnovaGenflo3112 latex, i.e. Carboxylated Styrene Butadiene Latex.

Part D. For comparison purposes, Example 3 was prepared as described in Parts A and B except that the UF binder was used alone without any modifier.

Part E. Wet web strength of the above uncured wet mats was measured in the following way. The uncured wet mat is laid over a sheet of plastic with a hole in the center. Weight is continuously added to the center of the mat to elongate the uncured mat to a defined distance. The final weight is recorded as the wet web strength of the uncured mat.

Part F. Also, all samples of Examples 1 to 3 were dried and cured from 5 to 9 seconds at 300° C. to obtain a 92 g/m$^2$ dry glass mats with 24% LOI (Loss on Ignition).

TABLE 1

BINDER COMPOSITIONS AND LAB TESTING RESULTS EXAMPLES 1–3

| Ingredient | Example 1 (Invention) | Example 2 (Comparative) | Example 3 (Control) |
|---|---|---|---|
| Binder | Borden FG 486D | Borden FG 486D | Borden FG 486D |
| Binder Modifier | Styleze ® 2000 | OmnovaGenflo3112 | None |
| Modifier Chemistry | Vinylpyrrolidone/acrylic acid/lauryl methacrylate terpolymer | Carboxylated Styrene Butadiene Copolymer | None |
| UF: Modifier (dried w/w) | 99/1 | 99/1 | 100 |
| Wet Web Strength (gf) | 212 | 159 | 151 |
| Mat Dry Tensile (N) | 352 | 271 | 244 |

It will be apparent to those skilled in the art that variations and modifications of the present invention can be made without departing from the scope or spirit of the invention. For example, embodiments of the fiber mat can be used in a building material including, but not limited to: underlayment, insulation facers, floor and ceiling tile, vehicle parts, and or any other suitable building material. Thus, it is intended that the present invention cover all such modifications and variations of the invention, provided the modifications and vibrations come within the scope of the appended claims and their equivalents.

What is claimed is:

1. A fiber glass mat comprising:

a resinous fiber binder:

a plurality of fibers, said fibers fixedly distributed in said binder; and a vinylpyrrolidone/acrylic acid/lauryl methacrylate terpolymer comprising from about 0.1 wt. % to about 50 wt. %, based on the weight of said binder.

2. The fiber mat of claim 1, wherein said resinous fiber binder comprises a formaldehyde binder.

3. The fiber mat of claim 2, wherein said formaldehyde binder is selected from the group consisting of a urea/formaldehyde binder, a phenol/formaldehyde binder, and a melamine/formaldehyde binder.

4. The fiber mat of claim 1, wherein the weight ratio of said resinous fiber binder to said terpolymer is in the range from about 200:1 to about 4:1.

5. The fiber mat of claim 1, wherein said mat contains from about 55 wt. % to about 98 wt. % of said fibers and from about 0.05 wt. % to about 45 wt. % of said resinous fiber binder.

6. The fiber mat of claim 1, wherein said mat contains from about 55 wt. % to about 98 wt. % glass fibers and from about 15 wt. % to about 30 wt. % of said resinous fiber binder.

* * * * *